US008439104B2

(12) United States Patent
de la Cruz et al.

(10) Patent No.: US 8,439,104 B2
(45) Date of Patent: May 14, 2013

(54) MULTICHANNEL HEAT EXCHANGER WITH IMPROVED FLOW DISTRIBUTION

(75) Inventors: Jose Ruel Yalung de la Cruz, Dover, PA (US); Mustafa K. Yanik, York, PA (US); William L. Kopko, Jacobus, PA (US)

(73) Assignee: Johnson Controls Technology Company, Holland, MI (US)

( * ) Notice: Subject to any disclaimer, the term of this patent is extended or adjusted under 35 U.S.C. 154(b) by 568 days.

(21) Appl. No.: 12/580,397

(22) Filed: Oct. 16, 2009

(65) Prior Publication Data

US 2011/0088883 A1 Apr. 21, 2011

(51) Int. Cl.
*F28F 9/02* (2006.01)
*F28F 13/00* (2006.01)
*F28D 1/02* (2006.01)

(52) U.S. Cl.
USPC ..... 165/174; 165/173; 165/175; 165/153; 165/146; 165/150

(58) Field of Classification Search ..... 165/153, 165/173–175, 146, 147, 150–151
See application file for complete search history.

(56) References Cited

U.S. PATENT DOCUMENTS

| | | | | |
|---|---|---|---|---|
| 3,229,722 | A | 1/1966 | Kritzer | |
| 4,309,987 | A * | 1/1982 | Higgins, Jr. | 126/664 |
| 4,971,145 | A | 11/1990 | Lyon | |
| 5,062,476 | A | 11/1991 | Ryan et al. | |
| 5,069,277 | A * | 12/1991 | Nakamura et al. | 165/173 |
| 5,076,354 | A * | 12/1991 | Nishishita | 165/146 |
| 5,168,925 | A | 12/1992 | Suzumura | |
| 5,186,249 | A | 2/1993 | Bhatti et al. | |
| 5,246,066 | A | 9/1993 | Morgan et al. | |
| 5,327,959 | A | 7/1994 | Saperstein | |
| 5,372,188 | A | 12/1994 | Dudley | |
| 5,586,598 | A | 12/1996 | Tanaka et al. | |
| 5,607,012 | A | 3/1997 | Buchanan et al. | |
| 5,765,393 | A | 6/1998 | Shlak et al. | |
| 5,826,646 | A | 10/1998 | Bae | |
| 5,898,996 | A | 5/1999 | Buchanan et al. | |
| 5,901,782 | A | 5/1999 | Voss | |

(Continued)

FOREIGN PATENT DOCUMENTS

| | | |
|---|---|---|
| DE | 19740114 | 3/1999 |
| EP | 0583851 | 9/1986 |

(Continued)

OTHER PUBLICATIONS

International Search Report and Written Opinion of PCT Application No. PCT/US2010/042455 dated Nov. 7, 2011.

*Primary Examiner* — Frantz Jules
*Assistant Examiner* — Joseph Trpisovsky
(74) *Attorney, Agent, or Firm* — Fletcher Yoder P.C.

(57) ABSTRACT

Heating, ventilation, air conditioning, and refrigeration (HVAC&R) systems and heat exchangers are provided that include multichannel tube configurations designed to reduce refrigerant pressure drop through a heat exchanger manifold. In certain embodiments, tubes inserted within the manifold adjacent to a refrigerant inlet have non-rectangular or recessed end profiles configured to increase flow area near the inlet, thereby reducing a pressure drop through the manifold. In further embodiments, insertion depths of the tubes within the manifold vary based on distance from the inlet. This configuration may establish a larger flow area adjacent to the inlet, thus reducing the pressure drop and increasing heat exchanger efficiency.

22 Claims, 9 Drawing Sheets

U.S. PATENT DOCUMENTS

| | | | | |
|---|---|---|---|---|
| 5,904,206 | A | 5/1999 | Kroetsch | |
| 5,910,167 | A | 6/1999 | Reinke | |
| 5,941,303 | A | 8/1999 | Gowan et al. | |
| 6,115,918 | A | 9/2000 | Kent | |
| 6,116,335 | A | 9/2000 | Beamer et al. | |
| 6,237,677 | B1 | 5/2001 | Kent et al. | |
| 6,467,535 | B1 | 10/2002 | Shembekar et al. | |
| 6,513,582 | B2 | 2/2003 | Krupa et al. | |
| 6,619,380 | B1 | 9/2003 | Hartman et al. | |
| 6,799,631 | B2 | 10/2004 | Acre | |
| 6,868,696 | B2 | 3/2005 | Ikuta | |
| 6,904,770 | B2 | 6/2005 | Telesz et al. | |
| 6,932,153 | B2 | 8/2005 | Ko | |
| 6,964,296 | B2 | 11/2005 | Memory | |
| 7,007,743 | B2 | 3/2006 | Calhoun et al. | |
| 7,021,370 | B2 | 4/2006 | Papapanu | |
| 7,024,884 | B2 | 4/2006 | Kent et al. | |
| 7,059,050 | B2 | 6/2006 | Calhoun et al. | |
| 7,066,243 | B2 | 6/2006 | Horiuchi | |
| 7,080,683 | B2 | 7/2006 | Bhatti et al. | |
| 7,152,669 | B2 | 12/2006 | Kroetsch et al. | |
| 7,201,015 | B2 | 4/2007 | Feldman | |
| 7,213,640 | B2 | 5/2007 | Fuller | |
| 2005/0241816 | A1 | 11/2005 | Shabtay et al. | |
| 2005/0269069 | A1 | 12/2005 | Hancock | |
| 2006/0101849 | A1 * | 5/2006 | Taras et al. | 62/515 |
| 2007/0017664 | A1 | 1/2007 | Beamer et al. | |
| 2007/0039724 | A1 | 2/2007 | Trumbower | |
| 2007/0119580 | A1 | 5/2007 | Wawzyniak | |
| 2007/0227695 | A1 | 10/2007 | Beamer et al. | |
| 2007/0246206 | A1 | 10/2007 | Gong et al. | |
| 2008/0023182 | A1 | 1/2008 | Beamer et al. | |
| 2008/0023183 | A1 | 1/2008 | Beamer et al. | |
| 2008/0023184 | A1 | 1/2008 | Beamer et al. | |
| 2008/0023185 | A1 | 1/2008 | Beamer et al. | |
| 2008/0023186 | A1 | 1/2008 | Beamer et al. | |
| 2008/0060199 | A1 | 3/2008 | Fuller et al. | |
| 2008/0078541 | A1 | 4/2008 | Beamer et al. | |
| 2008/0092587 | A1 | 4/2008 | Gorbounov et al. | |
| 2008/0093062 | A1 | 4/2008 | Gorbounov et al. | |
| 2008/0099191 | A1 | 5/2008 | Taras et al. | |
| 2008/0105420 | A1 | 5/2008 | Taras et al. | |

FOREIGN PATENT DOCUMENTS

| | | | |
|---|---|---|---|
| EP | 0851188 | A2 | 7/1998 |
| EP | 1426714 | | 6/2004 |
| JP | 08233409 | * | 9/1996 |
| JP | 8233409 | A | 9/1996 |
| JP | 9250894 | A | 9/1997 |
| WO | WO02/103263 | | 12/2002 |
| WO | WO02/103270 | | 12/2002 |
| WO | WO2006/083426 | | 8/2006 |
| WO | WO2006/083435 | | 8/2006 |
| WO | WO2006/083442 | | 8/2006 |
| WO | WO2006/083443 | | 8/2006 |
| WO | WO2006/083446 | | 8/2006 |
| WO | WO2006/083447 | | 8/2006 |
| WO | WO2006/083448 | | 8/2006 |
| WO | WO2006/083449 | | 8/2006 |
| WO | WO2006/083450 | | 8/2006 |
| WO | WO2006/083451 | | 8/2006 |
| WO | WO2007/129851 | | 11/2007 |
| WO | WO2008/038948 | | 4/2008 |
| WO | WO2008/060270 | | 5/2008 |
| WO | WO2008/064199 | | 5/2008 |
| WO | WO2008/064219 | | 5/2008 |
| WO | WO2008/064228 | | 5/2008 |
| WO | WO2008/064238 | | 5/2008 |
| WO | WO2008/064243 | | 5/2008 |
| WO | 2008072730 | A1 | 6/2008 |
| WO | 2008079135 | A1 | 7/2008 |
| WO | WO2008/105760 | | 9/2008 |

* cited by examiner

FIG. 1
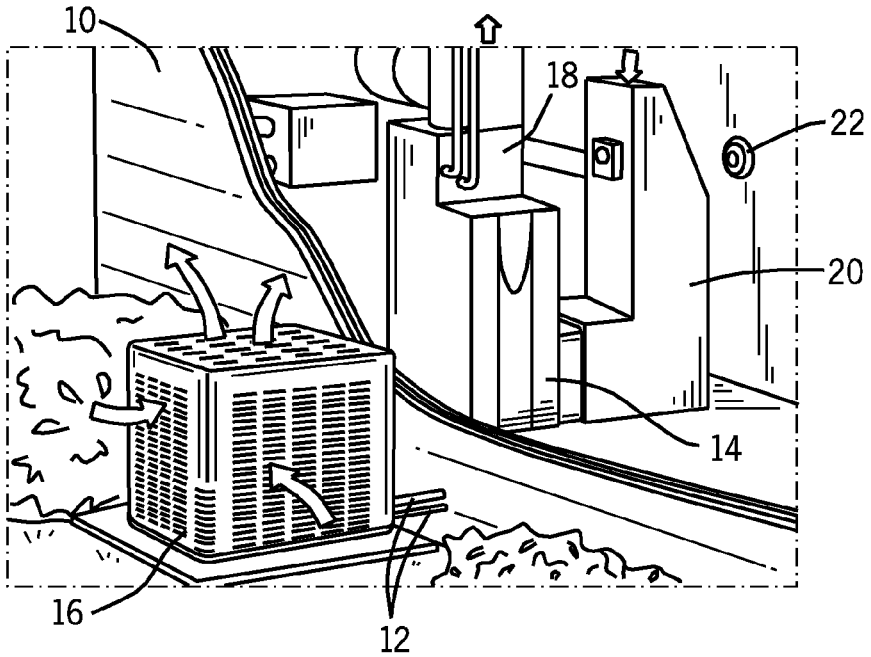
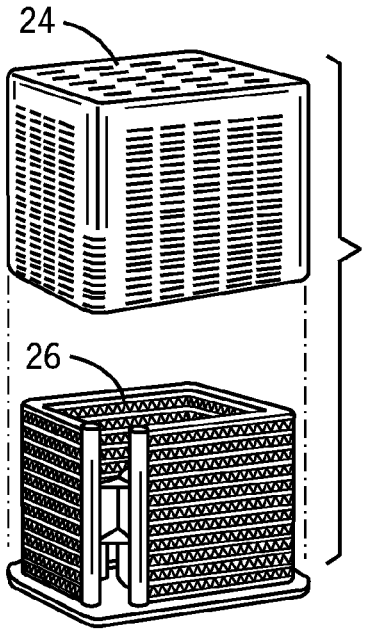
FIG. 2

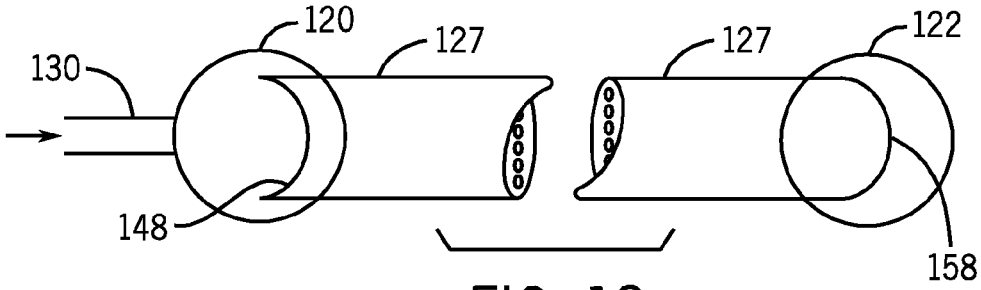
FIG. 13
FIG. 14
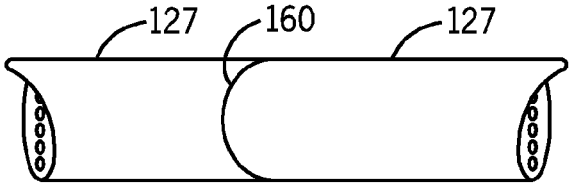
FIG. 15
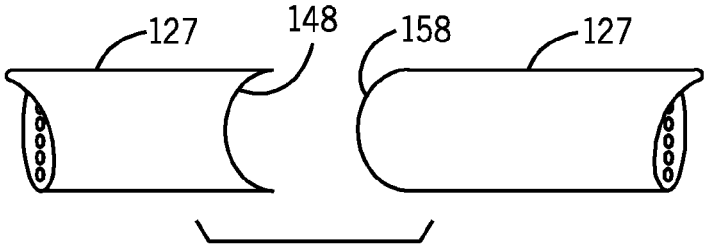
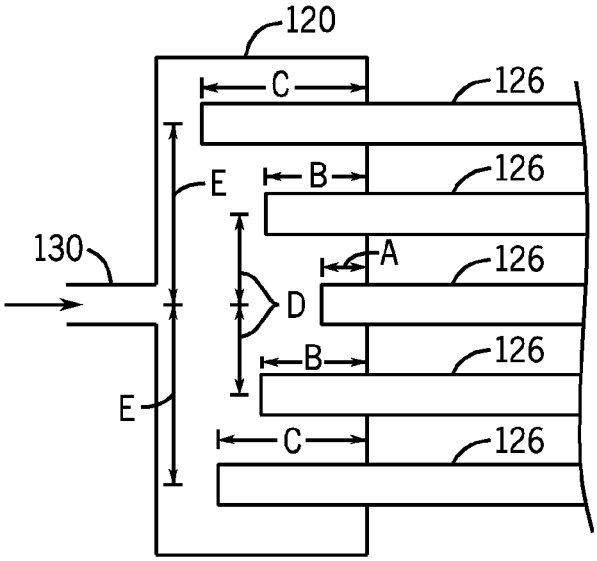
FIG. 16

MULTICHANNEL HEAT EXCHANGER WITH IMPROVED FLOW DISTRIBUTION

BACKGROUND

The invention relates generally to tube configurations for multichannel heat exchangers.

Heat exchangers are used in heating, ventilation, air conditioning, and refrigeration (HVAC&R) systems. Multichannel heat exchangers generally include multichannel tubes for flowing refrigerant through the heat exchanger. Each multichannel tube may contain several individual flow channels, or paths. Fins may be positioned between the tubes to facilitate heat transfer between refrigerant contained within the flow paths and an external fluid passing over the tubes. Moreover, multichannel heat exchangers may be used in small tonnage systems, such as residential systems, or in large tonnage systems, such as industrial chiller systems.

A typical multichannel heat exchanger may include several multichannel tubes, each protruding into inlet and outlet manifolds at relatively equal depths. Refrigerant may enter the inlet manifold through an inlet, and as the refrigerant flows through the manifold, a portion of the refrigerant may be diverted into each of the multichannel tubes. The refrigerant volumetric flow rate may be the highest near the manifold refrigerant inlet, and the flow rate may decrease as the refrigerant enters the multichannel tubes, successively farther from the position of the manifold inlet. However, because the diameter of the manifold remains substantially constant along the length of the manifold, the refrigerant may experience a pressure drop near the inlet. Specifically, because typical heat exchangers employ multichannel tubes having substantially rectangular ends inserted within the inlet manifold at relatively equal depths, a small flow area is formed near the refrigerant inlet. This small flow area may induce a pressure drop within the inlet manifold, thereby reducing efficiency of the heat exchanger. Accordingly, it would be desirable to provide a larger flow area near the refrigerant inlet to reduce the pressure drop through the inlet manifold.

SUMMARY

The present invention relates to heat exchangers with tube profiles and insertion depths designed to respond to such needs. The heat exchangers described below may be employed in various designs of HVAC&R systems, including air conditioners, heat pumps, light commercial industrial, chiller, and other systems and system components. The embodiments may include tubes with non-rectangular or recessed ends configured to increase flow area adjacent to a refrigerant inlet to facilitate reduced pressure drop through a manifold. Embodiments also may include manifolds with tubes inserted at depths dependent on distance from the refrigerant inlet.

DRAWINGS

FIG. 1 is a perspective view of an exemplary residential air conditioning or heat pump system that employs heat exchangers.

FIG. 2 is a partially exploded view of the outside unit of the system of FIG. 1, with an upper assembly lifted to expose certain system components.

FIG. 13 is a top view of another embodiment of a tube that may be employed in the heat exchanger of FIG. 6.

FIG. 14 is a top view of an exemplary tube length that may be separated into two tubes for use in the heat exchanger of FIG. 6.

FIG. 15 is a top view of the exemplary tube length of FIG. 14 after separation of the two tubes.

FIG. 16 is an elevation view of an exemplary heat exchanger with multichannel tubes inserted at different depths.

DETAILED DESCRIPTION

Figure 3:
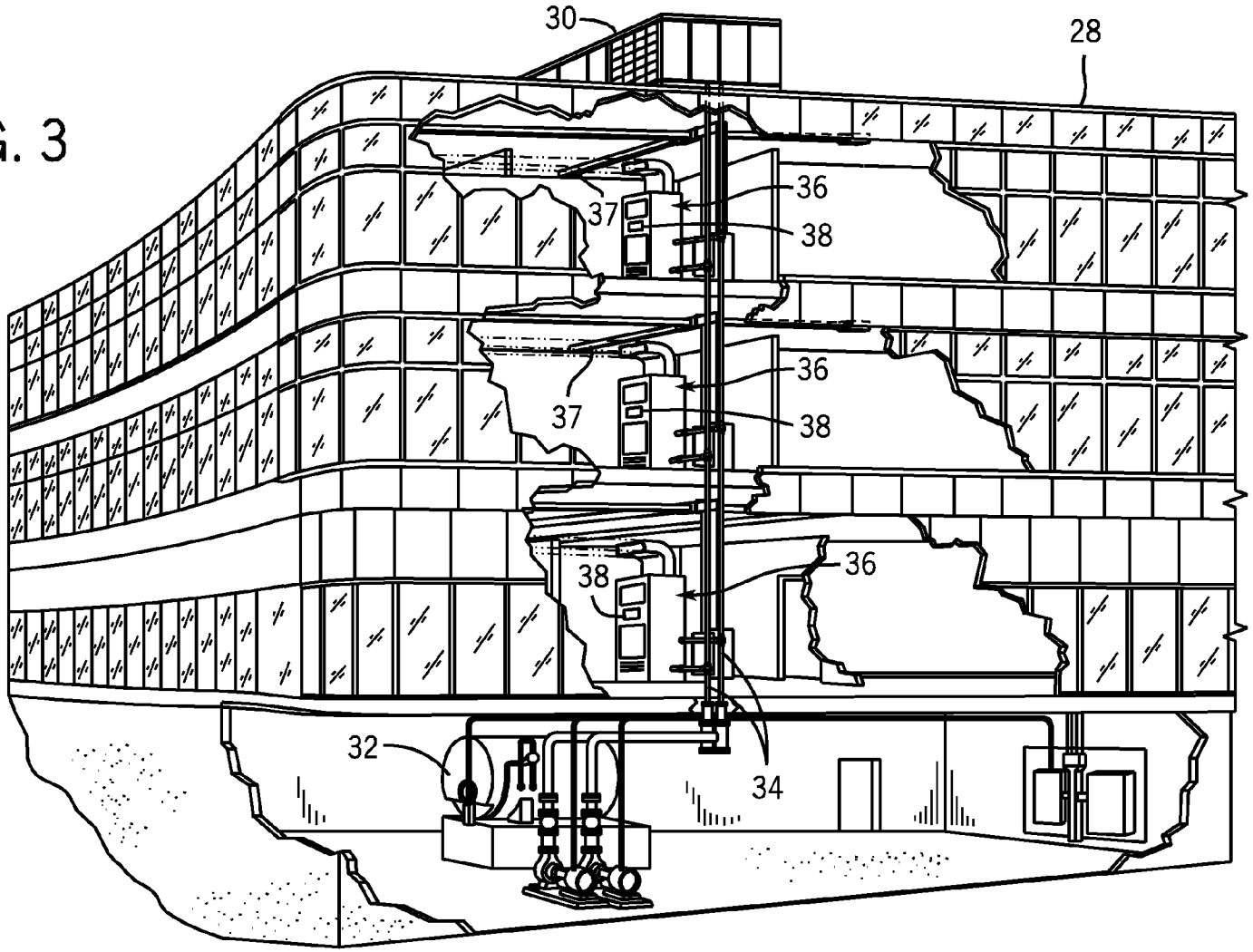
FIG. 3 is a perspective view of an exemplary commercial or industrial HVAC&R system that employs heat exchangers.

FIGS. 1 through 3 depict exemplary applications for heat exchangers. Such systems, in general, may be applied in a range of settings, both within the HVAC&R field and outside of that field. In presently contemplated applications, however, heat exchangers may be used in residential, commercial, light industrial, industrial, and in any other application for heating or cooling a volume or enclosure, such as a residence, building, structure, and so forth. Moreover, the heat exchangers may be used in industrial applications, where appropriate, for basic refrigeration and heating of various fluids.

FIG. 1 illustrates a residential heating and cooling system. In general, a residence 10, will include refrigerant conduits 12 that operatively couple an indoor unit 14 to an outdoor unit 16. Indoor unit 14 may be positioned in a utility room, an attic, a basement, and so forth. Outdoor unit 16 is typically situated adjacent to a side of residence 10 and is covered by a shroud to protect the system components and to prevent leaves and other contaminants from entering the unit. Refrigerant conduits 12 transfer refrigerant between indoor unit 14 and outdoor unit 16, typically transferring primarily liquid refrigerant in one direction and primarily vaporized refrigerant in an opposite direction.

When the system shown in FIG. 1 is operating as an air conditioner, a coil in outdoor unit 16 serves as a condenser for recondensing vaporized refrigerant flowing from indoor unit 14 to outdoor unit 16 via one of the refrigerant conduits 12. In these applications, a coil of the indoor unit, designated by the reference numeral 18, serves as an evaporator coil. Evaporator coil 18 receives liquid refrigerant (which may be expanded by an expansion device, not shown) and evaporates the refrigerant before returning it to outdoor unit 16.

Outdoor unit 16 draws in environmental air through its sides as indicated by the arrows directed to the sides of the unit, forces the air through the outer unit coil by a means of a fan (not shown), and expels the air as indicated by the arrows above the outdoor unit. When operating as an air conditioner, the air is heated by the condenser coil within the outdoor unit and exits the top of the unit at a temperature higher than it entered the sides. Air is blown over indoor coil 18 and is then circulated through residence 10 by means of ductwork 20, as indicated by the arrows entering and exiting ductwork 20. The overall system operates to maintain a desired temperature as set by a thermostat 22 or other control device or system (e.g., a computer, digital or analog controller, etc.). When the temperature sensed inside the residence is higher than the set point on the thermostat (plus a small amount), the air conditioner will become operative to refrigerate additional air for circulation through the residence. When the temperature reaches the set point (minus a small amount), the unit will stop the refrigeration cycle temporarily.

When the unit in FIG. 1 operates as a heat pump, the roles of the coils are reversed. That is, the coil of outdoor unit 16 will serve as an evaporator to evaporate refrigerant and thereby cool air entering outdoor unit 16 as the air passes over the outdoor unit coil. Indoor coil 18 will receive a stream of air blown over it and will heat the air by condensing a refrigerant.

FIG. 2 illustrates a partially exploded view of one of the units shown in FIG. 1, in this case outdoor unit 16. In general, the unit may be thought of as including an upper assembly 24 made up of a shroud, a fan assembly, a fan drive motor, and so forth. In the illustration of FIG. 2, the fan and fan drive motor are not visible because they are hidden by the surrounding shroud. An outdoor coil 26 is housed within this shroud and is generally deposed to surround or at least partially surround other system components, such as a compressor, an expansion device, a control circuit.

FIG. 3 illustrates an exemplary application, in this case an HVAC&R system for building environmental management that may employ heat exchangers. A building 28 is cooled by a system that includes a chiller 30 and a boiler 32. As shown, chiller 30 is disposed on the roof of building 28 and boiler 32 is located in the basement; however, the chiller and boiler may be located in other equipment rooms or areas next to the building. Chiller 30 is an air cooled or water cooled device that implements a refrigeration cycle to cool water. Chiller 30 may be a stand-alone unit or may be part of a single package unit containing other equipment, such as a blower and/or integrated air handler. Boiler 32 is a closed vessel that includes a furnace to heat water. The water from chiller 30 and boiler 32 is circulated through building 28 by water conduits 34. Water conduits 34 are routed to air handlers 36, located on individual floors and within sections of building 28.

Air handlers 36 are coupled to ductwork 37 that is adapted to distribute air between the air handlers and may receive air from an outside intake (not shown). Air handlers 36 include heat exchangers that circulate cold water from chiller 30 and hot water from boiler 32 to provide heated or cooled air. Fans, within air handlers 36, draw air through the heat exchangers and direct the conditioned air to environments within building 28, such as rooms, apartments or offices, to maintain the environments at a designated temperature. A control device, shown here as including a thermostat 38, may be used to designate the temperature of the conditioned air. Control device 38 also may be used to control the flow of air through and from air handlers 36. Other devices may, of course, be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building.

Figure 4:
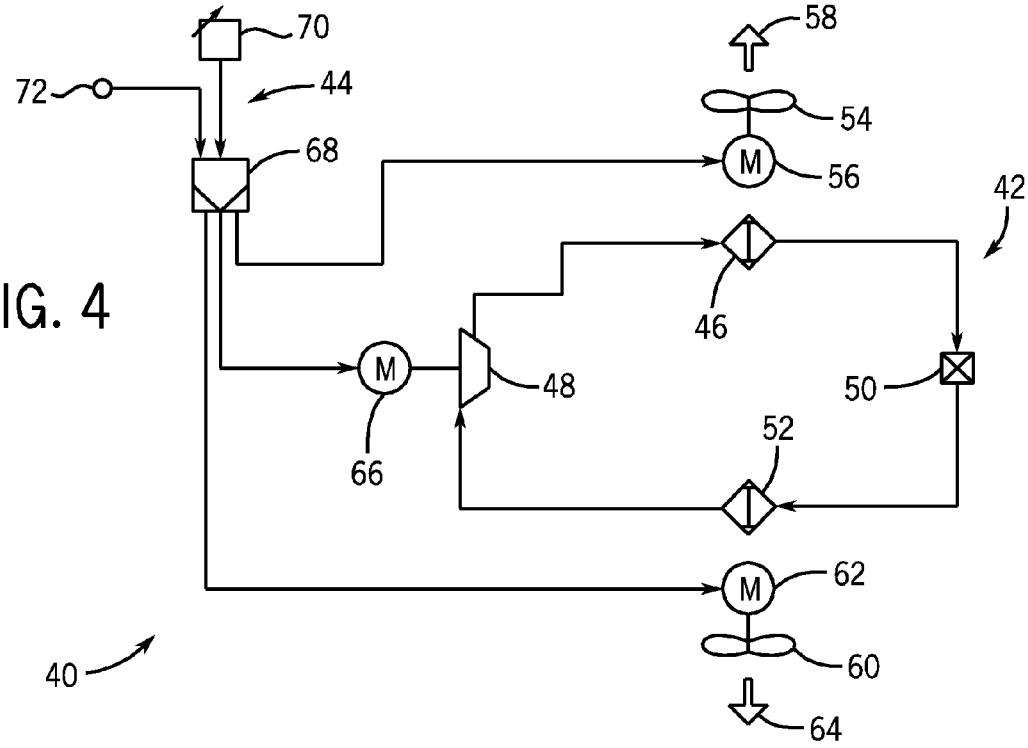
FIG. 4 is a diagrammatical overview of an exemplary air conditioning system that may employ one or more heat exchangers.

FIG. 4 depicts an air conditioning system 40, which may employ multichannel tube heat exchangers. Refrigerant flows through system 40 within closed refrigeration loop 42. The refrigerant may be any fluid that absorbs and extracts heat. For example, the refrigerant may be hydrofluorocarbon (HFC) based R-410A, R-407C, or R-134a, or it may be carbon dioxide (R-744) or ammonia (R-717). Air conditioning system 40 includes control devices 44 that enable the system to cool an environment to a prescribed temperature.

System 40 cools an environment by cycling refrigerant within closed refrigeration loop 42 through a condenser 46, a compressor 48, an expansion device 50, and an evaporator 52. The refrigerant enters condenser 46 as a high pressure and temperature vapor and flows through the multichannel tubes of the condenser. A fan 54, which is driven by a motor 56, draws air across the multichannel tubes. The fan may push or pull air across the tubes. As the air flows across the tubes, heat transfers from the refrigerant vapor to the air, producing heated air 58 and causing the refrigerant vapor to condense into a liquid. The liquid refrigerant then flows into an expansion device 50 where the refrigerant expands to become a low pressure and temperature liquid. Typically, expansion device 50 will be a thermal expansion valve (TXV); however, according to other exemplary embodiments, the expansion device may be an orifice or a capillary tube. After the refrigerant exits the expansion device, some vapor refrigerant may be present in addition to the liquid refrigerant.

From expansion device 50, the refrigerant enters evaporator 52 and flows through the evaporator multichannel tubes. A fan 60, which is driven by a motor 62, draws air across the multichannel tubes. As the air flows across the tubes, heat transfers from the air to the refrigerant liquid, producing cooled air 64 and causing the refrigerant liquid to boil into a vapor. According to certain embodiments, the fan may be replaced by a pump that draws fluid across the multichannel tubes.

The refrigerant then flows to compressor 48 as a low pressure and temperature vapor. Compressor 48 reduces the volume available for the refrigerant vapor, consequently, increasing the pressure and temperature of the vapor refrigerant. The compressor may be any suitable compressor such as a screw compressor, reciprocating compressor, rotary compressor, swing link compressor, scroll compressor, or turbine compressor. Compressor 48 is driven by a motor 66 that receives power from a variable speed drive (VSD) or a direct AC or DC power source. According to an exemplary embodiment, motor 66 receives fixed line voltage and frequency from an AC power source although in certain applications the motor may be driven by a variable voltage or frequency drive. The motor may be a switched reluctance (SR) motor, an induction motor, an electronically commutated permanent magnet motor (ECM), or any other suitable motor type. The refrigerant exits compressor 48 as a high temperature and pressure vapor that is ready to enter the condenser and begin the refrigeration cycle again.

The control devices 44, which include control circuitry 68, an input device 70, and a temperature sensor 72, govern the operation of the refrigeration cycle. Control circuitry 68 is coupled to the motors 56, 62, and 66 that drive condenser fan 54, evaporator fan 60, and compressor 48, respectively. Control circuitry 68 uses information received from input device 70 and sensor 72 to determine when to operate the motors 56, 62, and 66 that drive the air conditioning system. In certain applications, the input device may be a conventional thermostat. However, the input device is not limited to thermostats, and more generally, any source of a fixed or changing set point may be employed. These may include local or remote command devices, computer systems and processors, and mechanical, electrical and electromechanical devices that manually or automatically set a temperature-related signal that the system receives. For example, in a residential air conditioning system, the input device may be a programmable 24-volt thermostat that provides a temperature set point to the control circuitry.

Sensor 72 determines the ambient air temperature and provides the temperature to control circuitry 68. Control circuitry 68 then compares the temperature received from the sensor to the temperature set point received from the input device. If the temperature is higher than the set point, control circuitry 68 may turn on motors 56, 62, and 66 to run air conditioning system 40. The control circuitry may execute hardware or software control algorithms to regulate the air conditioning system. According to exemplary embodiments, the control circuitry may include an analog to digital (A/D) converter, a microprocessor, a non-volatile memory, and an interface board. Other devices may, of course, be included in the system, such as additional pressure and/or temperature transducers or switches that sense temperatures and pressures of the refrigerant, the heat exchangers, the inlet and outlet air, and so forth.

Figure 5:
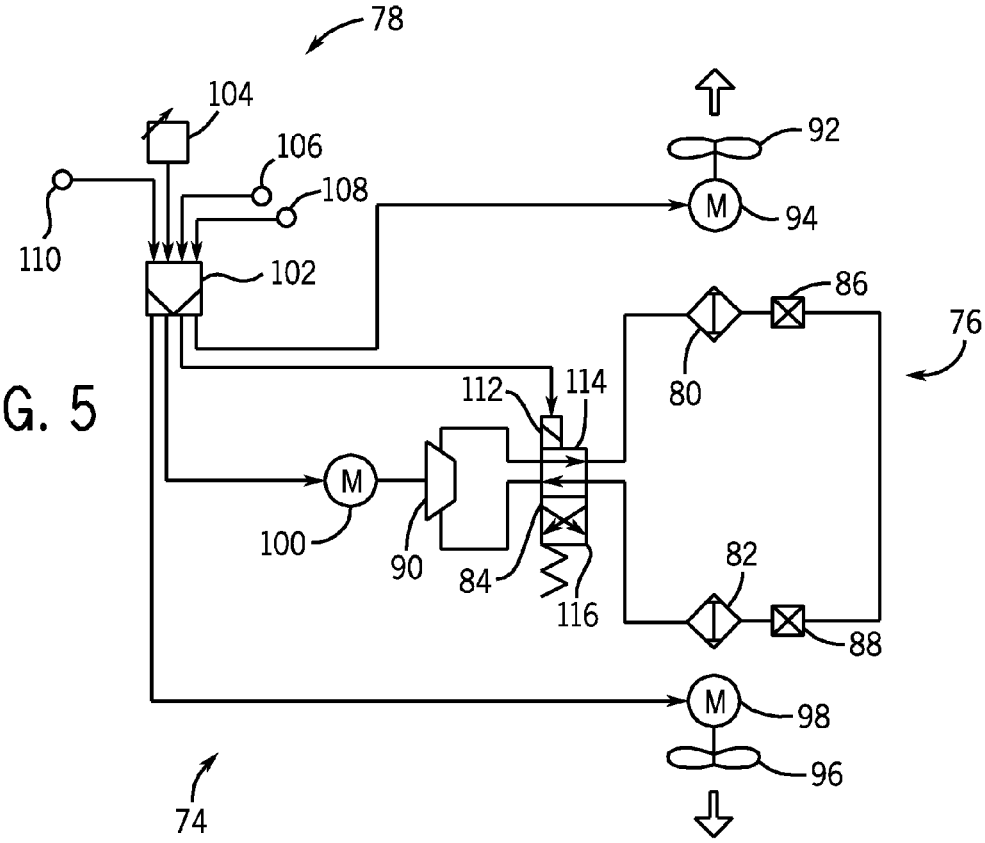
FIG. 5 is a diagrammatical overview of an exemplary heat pump system that may employ one or more heat exchangers.

FIG. 5 illustrates a heat pump system 74 that may employ multichannel tube heat exchangers. Because the heat pump may be used for both heating and cooling, refrigerant flows through a reversible refrigeration/heating loop 76. The refrigerant may be any fluid that absorbs and extracts heat. The heating and cooling operations are regulated by control devices 78.

Heat pump system 74 includes an outside coil 80 and an inside coil 82 that both operate as heat exchangers. The coils may function either as an evaporator or a condenser depending on the heat pump operation mode. For example, when heat pump system 74 is operating in cooling (or "AC") mode, outside coil 80 functions as a condenser, releasing heat to the outside air, while inside coil 82 functions as an evaporator, absorbing heat from the inside air. When heat pump system 74 is operating in heating mode, outside coil 80 functions as an evaporator, absorbing heat from the outside air, while inside coil 82 functions as a condenser, releasing heat to the inside air. A reversing valve 84 is positioned on reversible loop 76 between the coils to control the direction of refrigerant flow and thereby to switch the heat pump between heating mode and cooling mode.

Heat pump system 74 also includes two metering devices 86 and 88 for decreasing the pressure and temperature of the refrigerant before it enters the evaporator. The metering devices also regulate the refrigerant flow entering the evaporator so that the amount of refrigerant entering the evaporator equals, or approximately equals, the amount of refrigerant exiting the evaporator. The metering device used depends on the heat pump operation mode. For example, when heat pump system 74 is operating in cooling mode, refrigerant bypasses metering device 86 and flows through metering device 88 before entering inside coil 82, which acts as an evaporator. In another example, when heat pump system 74 is operating in heating mode, refrigerant bypasses metering device 88 and flows through metering device 86 before entering outside coil 80, which acts as an evaporator. According to other exemplary embodiments, a single metering device may be used for both heating mode and cooling mode. The metering devices typically are thermal expansion valves (TXV), but also may be orifices or capillary tubes.

The refrigerant enters the evaporator, which is outside coil 80 in heating mode and inside coil 82 in cooling mode, as a low temperature and pressure liquid. Some vapor refrigerant also may be present as a result of the expansion process that occurs in metering device 86 or 88. The refrigerant flows through multichannel tubes in the evaporator and absorbs heat from the air changing the refrigerant into a vapor. In cooling mode, the indoor air flowing across the multichannel tubes also may be dehumidified. The moisture from the air may condense on the outer surface of the multichannel tubes and consequently be removed from the air.

After exiting the evaporator, the refrigerant passes through reversing valve 84 and into a compressor 90. Compressor 90 decreases the volume of the refrigerant vapor, thereby, increasing the temperature and pressure of the vapor. The compressor may be any suitable compressor such as a screw compressor, reciprocating compressor, rotary compressor, swing link compressor, scroll compressor, or turbine compressor.

From compressor 90, the increased temperature and pressure vapor refrigerant flows into a condenser, the location of which is determined by the heat pump mode. In cooling mode, the refrigerant flows into outside coil 80 (acting as a condenser). A fan 92, which is powered by a motor 94, draws air across the multichannel tubes containing refrigerant vapor. According to certain exemplary embodiments, the fan may be replaced by a pump that draws fluid across the multichannel tubes. The heat from the refrigerant is transferred to the outside air causing the refrigerant to condense into a liquid. In heating mode, the refrigerant flows into inside coil 82 (acting as a condenser). A fan 96, which is powered by a motor 98, draws air across the multichannel tubes containing refrigerant vapor. The heat from the refrigerant is transferred to the inside air causing the refrigerant to condense into a liquid.

After exiting the condenser, the refrigerant flows through the metering device (86 in heating mode and 88 in cooling mode) and returns to the evaporator (outside coil 80 in heating mode and inside coil 82 in cooling mode) where the process begins again.

In both heating and cooling modes, a motor 100 drives compressor 90 and circulates refrigerant through reversible refrigeration/heating loop 76. The motor may receive power either directly from an AC or DC power source or from a variable speed drive (VSD). The motor may be a switched reluctance (SR) motor, an induction motor, an electronically commutated permanent magnet motor (ECM), or any other suitable motor type.

The operation of motor 100 is controlled by control circuitry 102. Control circuitry 102 receives information from an input device 104 and sensors 106, 108, and 110 and uses the information to control the operation of heat pump system 74 in both cooling mode and heating mode. For example, in cooling mode, input device 104 provides a temperature set point to control circuitry 102. Sensor 110 measures the ambient indoor air temperature and provides it to control circuitry 102. Control circuitry 102 then compares the air temperature to the temperature set point and engages compressor motor 100 and fan motors 94 and 98 to run the cooling system if the air temperature is above the temperature set point. In heating mode, control circuitry 102 compares the air temperature from sensor 110 to the temperature set point from input device 104 and engages motors 94, 98, and 100 to run the heating system if the air temperature is below the temperature set point.

Control circuitry 102 also uses information received from input device 104 to switch heat pump system 74 between heating mode and cooling mode. For example, if input device 104 is set to cooling mode, control circuitry 102 will send a signal to a solenoid 112 to place reversing valve 84 in an air conditioning position 114. Consequently, the refrigerant will flow through reversible loop 76 as follows: the refrigerant exits compressor 90, is condensed in outside coil 80, is expanded by metering device 88, and is evaporated by inside coil 82. If the input device is set to heating mode, control circuitry 102 will send a signal to solenoid 112 to place reversing valve 84 in a heat pump position 116. Consequently, the refrigerant will flow through the reversible loop 76 as follows: the refrigerant exits compressor 90, is condensed in inside coil 82, is expanded by metering device 86, and is evaporated by outside coil 80.

The control circuitry may execute hardware or software control algorithms to regulate heat pump system 74. According to exemplary embodiments, the control circuitry may include an analog to digital (A/D) converter, a microprocessor, a non-volatile memory, and an interface board.

The control circuitry also may initiate a defrost cycle when the system is operating in heating mode. When the outdoor temperature approaches freezing, moisture in the outside air that is directed over outside coil 80 may condense and freeze on the coil. Sensor 106 measures the outside air temperature, and sensor 108 measures the temperature of outside coil 80. These sensors provide the temperature information to the control circuitry which determines when to initiate a defrost cycle. For example, if either sensor 106 or 108 provides a temperature below freezing to the control circuitry, system 74 may be placed in defrost mode. In defrost mode, solenoid 112 is actuated to place reversing valve 84 in air conditioning position 114, and motor 94 is shut off to discontinue air flow over the multichannel tubes. System 74 then operates in cooling mode until the increased temperature and pressure refrigerant flowing through outside coil 80 defrosts the coil. Once sensor 108 detects that coil 80 is defrosted, control circuitry 102 returns the reversing valve 84 to heat pump position 146. As will be appreciated by those skilled in the art, the defrost cycle can be set to occur at many different time and temperature combinations.

Figure 6:
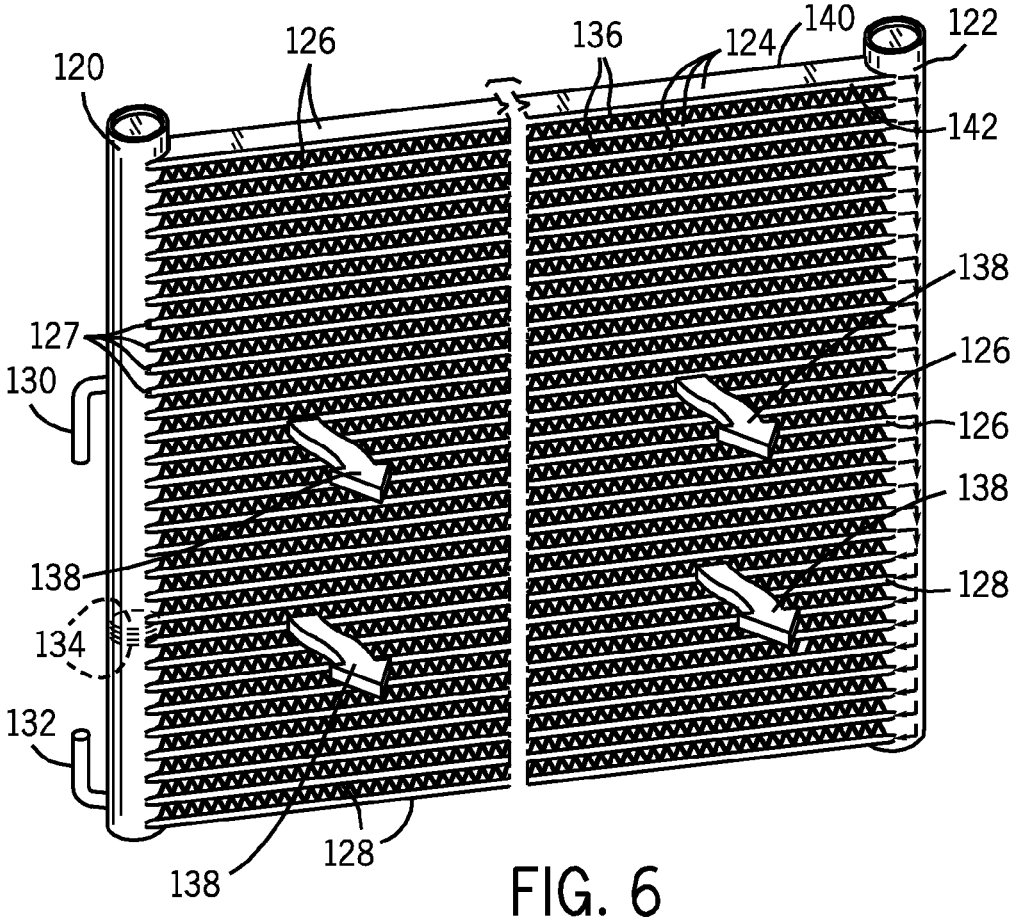
FIG. 6 is a perspective view of an exemplary heat exchanger containing multichannel tubes.

FIG. 6 is a perspective view of an exemplary heat exchanger that may be used in air conditioning system 40, shown in FIG. 4, or heat pump system 74, shown in FIG. 5. The exemplary heat exchanger may be a condenser 46, an evaporator 52, an outside coil 80, or an inside coil 82, as shown in FIGS. 4 and 5. It should be noted that in similar or other systems, the heat exchanger may be used as part of a chiller or in any other heat exchanging application. The heat exchanger includes manifolds 120 and 122 that are connected by multichannel tubes 124. Although 30 tubes are shown in FIG. 6, the number of tubes may vary. The manifolds and tubes may be constructed of aluminum or any other material that promotes good heat transfer.

Refrigerant flows from manifold 120 through a set of first tubes 126 to manifold 122. The refrigerant then returns to manifold 120 in an opposite direction through a set of second tubes 128. The first tubes may have the same configuration as the second tubes or the first tubes may have a different configuration from the second tubes. According to other exemplary embodiments, the heat exchanger may be rotated approximately 90 degrees so that the multichannel tubes run vertically between a top manifold and a bottom manifold. Furthermore, the heat exchanger may be inclined at an angle relative to the vertical. Although the multichannel tubes are depicted as having an oblong shape, the tubes may be any shape, such as tubes with a cross-section in the form of a rectangle, square, circle, oval, ellipse, triangle, trapezoid, or parallelogram. According to exemplary embodiments, the tubes may have an oblong cross-sectional shape with a height ranging from 0.5 mm to 3 mm and a width ranging from 18 mm to 45 mm. It should also be noted that the heat exchanger may be provided in a single plane or slab, or may include bends, corners, contours, and so forth.

As explained in detail below with reference to FIGS. 8 through 13, the heat exchanger may include recessed-end tubes 127, i.e., tubes 127 having non-rectangular end profiles. While four recessed-end tubes 127 are positioned adjacent to a refrigerant inlet 130 in the present embodiment, alternative embodiments may include more or fewer recessed-end tubes 127. For example, each multichannel tube 124 may have a recessed or non-rectangular end inserted within manifold 120. In certain embodiments, tubes 127 may have curved, or polygonal tube ends extending within manifold 120. The tube end profile may vary among tubes 127 within the heat exchanger. In addition, for a single tube 127, the profile of the tube end within manifold 120 may be different than the tube end within manifold 122. Varying the shape of tube ends may reduce the pressure drop within manifold 120, thereby increasing heat exchanger efficiency.

Refrigerant enters the heat exchanger through inlet 130 and exits the heat exchanger through an outlet 132. Although FIG. 6 depicts the inlet at an upper portion of manifold 120 and the outlet at a lower portion of manifold 120, the inlet and outlet positions may be interchanged so that the fluid enters at the lower portion and exits at the upper portion. The fluid also may enter and exit the manifold from multiple inlets and outlets positioned on bottom, side, or top surfaces of the manifold. Typically, as refrigerant flows through manifold 120, a portion of the refrigerant is diverted into each multichannel tube 126 or 127. The refrigerant flow may be highest near the refrigerant inlet 130, and the flow may decrease as the refrigerant enters the multichannel tubes 126 and/or 127, successively farther from the inlet position. However, because the diameter of manifold 120 remains substantially constant along the length of manifold 120, the refrigerant may experience a substantial pressure drop near the inlet. To compensate for this pressure drop, tube insertion depth may be decreased near inlet 130, thereby providing a larger flow area near inlet 130 and reducing the pressure drop through the manifold. In certain embodiments, tube insertion depth may increase as distance from inlet 130 increases. Reducing the pressure drop through manifold 120 may decrease the condensing temperature of the refrigerant, thereby increasing efficiency of the heat exchanger.

Baffles 134 separate the inlet and outlet portions of manifold 120. Although a double baffle 134 is illustrated, any number of one or more baffles may be employed to create separation of the inlet and outlet portions. It should also be noted that according to other exemplary embodiments, the inlet and outlet may be contained on separate manifolds, eliminating the need for a baffle.

Fins 136 are located between multichannel tubes 124 to promote the transfer of heat between the tubes and the environment. According to an exemplary embodiment, the fins are constructed of aluminum, brazed or otherwise joined to the tubes, and disposed generally perpendicular to the flow of refrigerant. However, according to other exemplary embodiments, the fins may be made of other materials that facilitate heat transfer and may extend parallel or at varying angles with respect to the flow of the refrigerant. The fins may be louvered fins, corrugated fins, or any other suitable type of fin.

When an external fluid, such as air, flows across multichannel tubes 124, as generally indicated by arrows 138, heat transfer occurs between the refrigerant flowing within tubes 124 and the external fluid. Typically, the external fluid, shown here as air, flows through fins 136 contacting the upper and lower sides of multichannel tubes 124. The external fluid first contacts multichannel tubes 124 at a leading edge 140, then flows across the width of the tubes, and lastly contacts a trailing edge 142 of the tubes. As the external fluid flows across the tubes, heat is transferred to and from the tubes to the external fluid. For example, in a condenser, the external fluid is generally cooler than the fluid flowing within the multichannel tubes. As the external fluid contacts the leading edge of a multichannel tube, heat is transferred from the refrigerant within the multichannel tube to the external fluid. Consequently, the external fluid is heated as it passes over the multichannel tubes and the refrigerant flowing within the multichannel tubes is cooled. In an evaporator, the external fluid generally has a temperature higher than the refrigerant flowing within the multichannel tubes. Consequently, as the external fluid contacts the leading edge of the multichannel tubes, heat is transferred from the external fluid to the refrigerant flowing in the tubes to heat the refrigerant. The external fluid leaving the multichannel tubes is then cooled because the heat has been transferred to the refrigerant.

Figure 7:
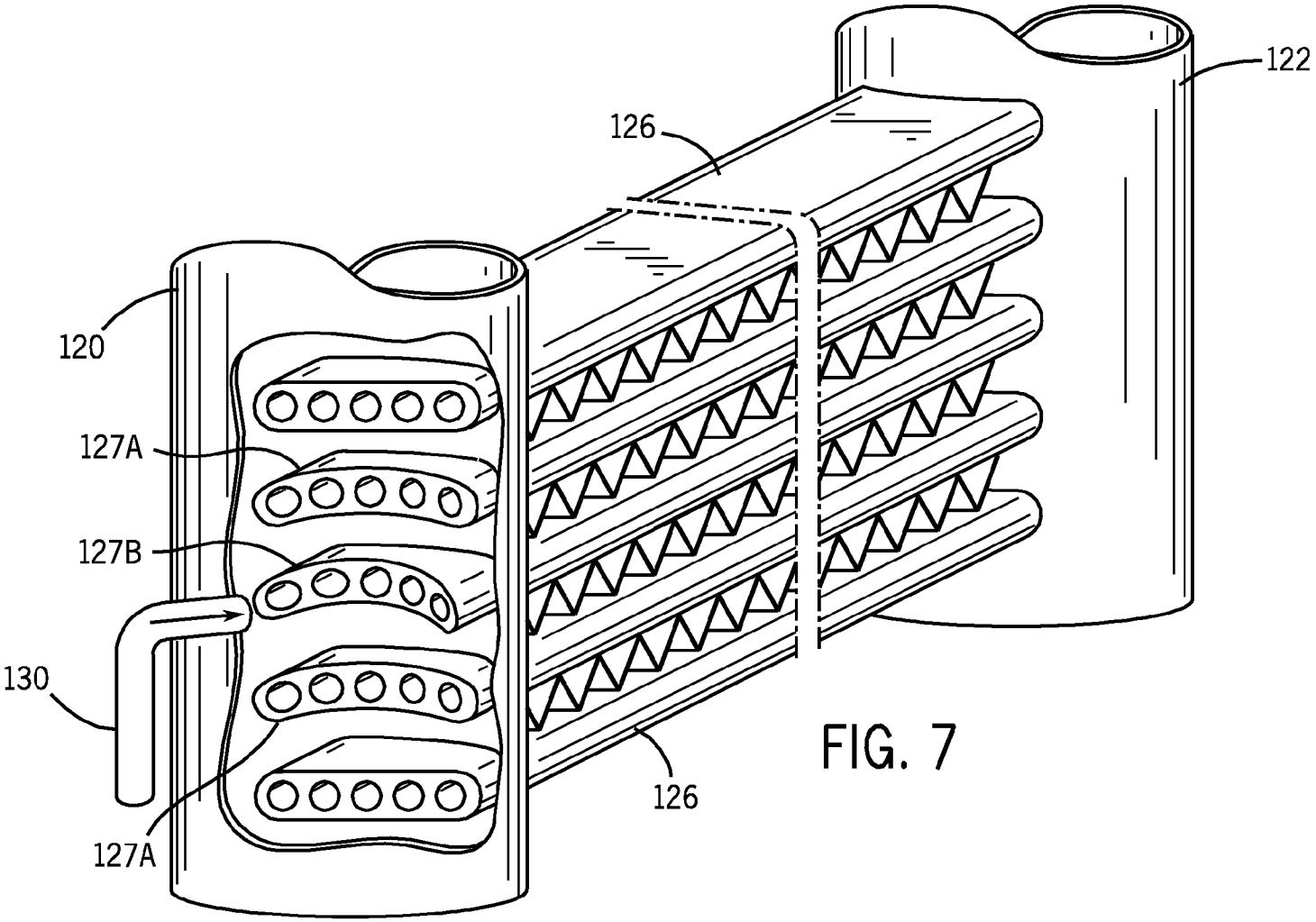
FIG. 7 is a detailed perspective view of the heat exchanger of FIG. 6 with a portion of the manifold cut away.

FIG. 7 shows the heat exchanger of FIG. 6 with a portion of the manifold cut away to illustrate the internal configuration of tubes 126 and recessed-end tubes 127. In the illustrated embodiment, a curvature of the recessed end of each tube 127 progressively increases along the length outwardly from the inlet. Specifically, tubes 126 have a substantially rectangular end profile, tubes 127A have a curved profile with a relatively large radius of curvature, and tube 127B has a curved profile with a relatively small radius of curvature. Because the curvature progressively decreases toward inlet 130, the flow area adjacent to inlet 130 is larger than the flow area nonadjacent to the inlet. This configuration may reduce the pressure drop through manifold 120 by providing a larger flow area at a location with the greatest refrigerant flow. As refrigerant from inlet 130 flows through the tubes 127, less refrigerant is present within manifold 120. Therefore, the flow area farther from inlet 130 may be decreased by providing tubes 127A with a larger radius of curvature. As the flow rate decreases further, tubes 126 having a substantially rectangular profile are employed farther from inlet 130. In alternative embodiments, more or fewer degrees of curvature may be employed. For example, in certain configurations, only a single profile 127B may be employed for each recessed-end tube 127. In further embodiments, 3, 4, 5, 6, 7, 8, or more different end profiles may be employed. In addition, multiple tubes 127 may be employed having each different end profile. For example, 2, 3, 4, 5, 6, 7, 8, or more tubes 127 having a profile similar to tube 127B may be positioned adjacent to inlet 130. By further example, multiple tubes having multiple profiles may be employed in certain embodiments. In alternative embodiments, each of the first tubes 126 may include a recessed end inserted within manifold 120.

In the present embodiment, inlet 130 is positioned at the approximate midpoint of manifold 120 with respect to a lateral direction of the tube ends. As illustrated, an apex of each tube 127 substantially coincides with the lateral position of inlet 130. In other words, each apex is proximate to a longitudinal axis extending generally parallel to manifold 120 and intersecting inlet 130. In alternative embodiments, inlet 130 may be positioned toward a laterally outward portion of tubes 127. In such configurations, the recessed profile of each tube 127 may be adjusted to provide an increased flow area near inlet 130. Specifically, the apex of each tube 127 may be shifted to correspond to the lateral position of inlet 130. In this manner, flow area near inlet 130 may be increased in embodiments employing laterally offset inlets 130.

As illustrated, each tube 126 and 127 includes multiple generally parallel flow paths configured to direct refrigerant between manifold 120 and manifold 122. The length of the flow paths adjacent to the apex is less than the length of the flow paths nonadjacent to the apex. For example, with regard to tube 127B, because the central flow path does not extend as far into manifold 120 as the lateral flow paths, the length of the central flow path is less than the length of the lateral flow paths. As previously discussed, this configuration establishes a larger flow area adjacent to inlet 130, thereby reducing the pressure drop of refrigerant through manifold 120.

Figure 8:
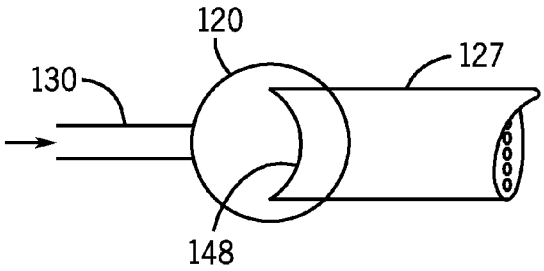
FIG. 8 is a top view of one embodiment of a tube that may be employed in the heat exchanger of FIG. 6.

FIG. 8 is a top view of an exemplary recessed-end tube 127 that may be used in the heat exchanger depicted in FIGS. 6 and 7. As depicted, tube 127 includes a curved end 148 with a generally concave shape. This shape may facilitate increased refrigerant flow through manifold 120 near inlet 130, thereby reducing the pressure drop through manifold 120. Specifically, the curved end 148 provides a larger flow area through manifold 120, thereby providing an increased flow path for refrigerant to flow to tubes 124 and/or 127 farther from inlet 130. The reduced pressure drop may increase heat exchanger efficiency compared to heat exchangers employing rectangular tube ends adjacent to inlet 130.

Figure 9:
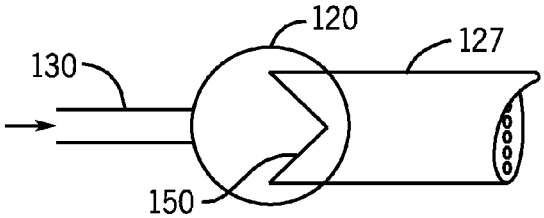
FIG. 9 is a top view of another embodiment of a tube that may be employed in the heat exchanger of FIG. 6.
Figure 10:
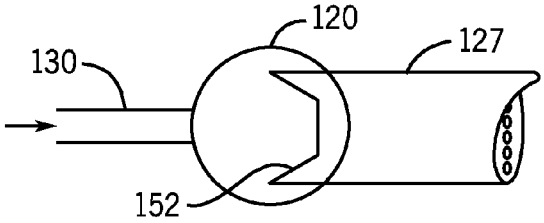
FIG. 10 is a top view of yet another embodiment of a tube that may be employed in the heat exchanger of FIG. 6.
Figure 11:
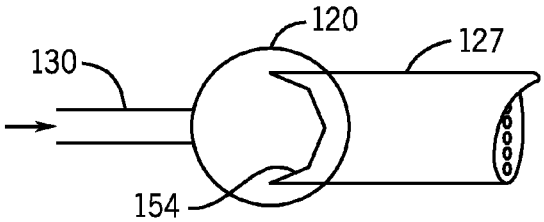
FIG. 11 is a top view of another embodiment of a tube that may be employed in the heat exchanger of FIG. 6.

FIGS. 9 through 11 depict additional configurations of tube ends that may reduce the pressure drop through manifold 120 by increasing flow area near inlet 130. FIG. 9 shows a tube 127 with a chevron shaped end 150. FIG. 10 shows a tube 127 with a half-hexagon shaped end 152. FIG. 11 depicts a tube 127 with a half-octagon shaped end 154. Each of these tube ends may establish additional flow area near inlet 130. Further, a shape may be selected based on individual heat exchanger properties and manufacturing considerations, such as size, flow rate, inlet refrigerant velocity, and system size, among other things. Further, other types of concave profiles, such as ellipses, half pentagons, half stars, and half moons, among others, may be employed on the tube ends. The tube end shapes described with respect to FIGS. 8 through 11 may be employed in single pass heat exchangers, dual-pass heat exchangers, and second and/or first tubes of dual pass heat exchangers on one or both ends. Moreover, each tube may include any combination of tube end shapes.

Figure 12:
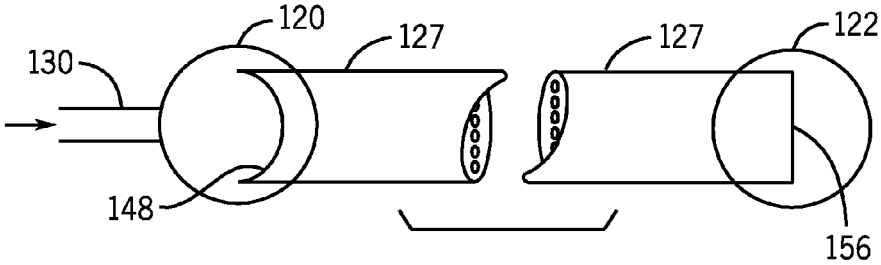
FIG. 12 is a top view of another embodiment of a tube that may be employed in the heat exchanger of FIG. 6.

FIG. 12 is a top view of one embodiment of a recessed-end tube 127 that may be used in the heat exchangers depicted in FIGS. 6 and 7. Tube 127 includes curved end 148 within first manifold 120, which may increase flow area near inlet 130 and decrease the pressure drop through manifold 120. The tube end 156 inserted into second manifold 122 has a rectangular shape. In certain embodiments, second manifold 122 may be less prone to experiencing a pressure drop, and, therefore, rectangular shapes may be employed. However, in other embodiments, the end of tube 127 within second manifold 122 may include any of the end shapes described above with respect to FIGS. 8 to 11.

FIG. 13 is a top view of another embodiment of a tube employing shaped ends. Tube 127 includes concave end 148 disposed within first manifold 120. The opposite end of tube 127 includes a convex end 158 that generally follows the curvature of concave end 148. Concave end 148 may receive refrigerant flow into tube 127 while convex end 158 expels refrigerant from tube 127.

FIG. 14 is a top view of a tube length that includes two tubes 127 before separation. In certain embodiments, multiple tubes 127 may be formed from one long tube length. For example, a curve 160 may be scored in a tube length to create a separation point between two tubes 127. The tube length may then be separated or pulled apart at curve 160 to create two tubes 127. FIG. 15 depicts tubes 127 after separation. One tube 127 includes convex end 158 and the other tube 127 includes concave end 148. The scoring process may be repeated to separate the other ends of tubes 127 from a tube length such that each end of a tube 127 has a convex end 158 and a concave end 148. The tubes 127 may then be assembled into a heat exchanger with each convex end disposed in second manifold 122 and each concave end disposed in first manifold 120. A similar process may be employed for chevron-shaped ends 150, half-hexagon ends 152, half-octagon ends 154 and rectangular ends 156.

FIG. 16 is an elevation view of a portion of an exemplary heat exchanger that may be used in air conditioning system 40, shown in FIG. 4, or heat pump system 74, shown in FIG. 5. The heat exchanger generally includes inlet manifold 120 with tubes 126 inserted at varying insertion depths A, B and C. Manifold 120 may represent an inlet manifold of a single pass/parallel flow heat exchanger or a multi-pass heat exchanger, such as the heat exchanger shown in FIG. 6. Refrigerant may enter manifold 120 through inlet 130. In general, the refrigerant flow may be greatest near inlet 130, and may decrease as the refrigerant flows away from inlet 130. Specifically, as refrigerant flows through manifold 120, a portion of the refrigerant is directed through each successive tube 126. Therefore, refrigerant flow decreases as distance from inlet 130 increases. However, because the diameter of manifold 120 remains substantially constant, refrigerant may experience a larger pressure drop near the inlet because of the higher refrigerant flow rate. Consequently, to reduce the pressure drop through manifold 120, insertion depths A, B and C may be varied as a function of tube distance D and E from inlet 130. Specifically, as the tube distances D and E from inlet 130 increase, the tube insertion depths A, B and C may also increase. Thus, tubes 126 that are located farther from inlet 130 have relatively large insertion depths while tubes 126 that are located closer to inlet 130 have relatively small insertion depths. The varied insertion depths A, B and C may establish a larger flow area near inlet 130, thereby reducing pressure drop through manifold 120.

As refrigerant enters manifold 120, the refrigerant flows into a region having a relatively large flow area. Specifically, because tube 126 positioned closest to inlet 130 has the smallest insertion depth A, a relatively large flow area is established near inlet 130. This large flow area enables refrigerant to flow through manifold 120 without substantial restriction, thereby resulting in a reduced pressure drop. Because a fraction of the refrigerant from inlet 130 flows into the central tube 126, less refrigerant flow is present in manifold 120 above and below the central tube 126. As a result, tubes positioned distance D away from inlet 130 may have a greater insertion depth B. Similarly, a fraction of the refrigerant flows into the tubes 126 positioned distance D away from inlet 130, thereby further reducing the flow of refrigerant through manifold 120. Consequently, tubes positioned distance E away from inlet 130 may have the greatest insertion depth C. As generally illustrated by tubes 126, the insertion depths A, B and C may increase as the distances D and E from inlet 130 increase.

The successive increase in insertion depths A, B and C may reduce the pressure drop through manifold 120, thereby increasing efficiency of the heat exchanger. Specifically, by providing a larger flow area adjacent to inlet 130, refrigerant pressure through the heat exchanger may be substantially maintained. As will be appreciated, in embodiments where the heat exchanger is a condenser, reducing the pressure drop may reduce the refrigerant condensing temperature. The lower condensing temperature may facilitate increased efficiency and reduced condenser size particularly when compared to condensers employing tubes 126 inserted at equal depths.

In certain embodiments, recessed or non-rectangular tube ends may be combined with variable insertion depths to increase flow area adjacent to the inlet. For example, tube 126 positioned closest to inlet 130 may have a recessed tube end with a relatively small radius of curvature. Tubes 126 positioned distance D from inlet 130 may have recessed tube ends with a relatively large radius of curvature. Tubes 126 positioned distance E from inlet 130 may have substantially rectangular tube ends. The combination of increasing insertion depth based on distance from inlet 130 and employing recessed tube ends may increase flow area near inlet 130, thereby reducing the pressure drop through manifold 120.

Figure 17:
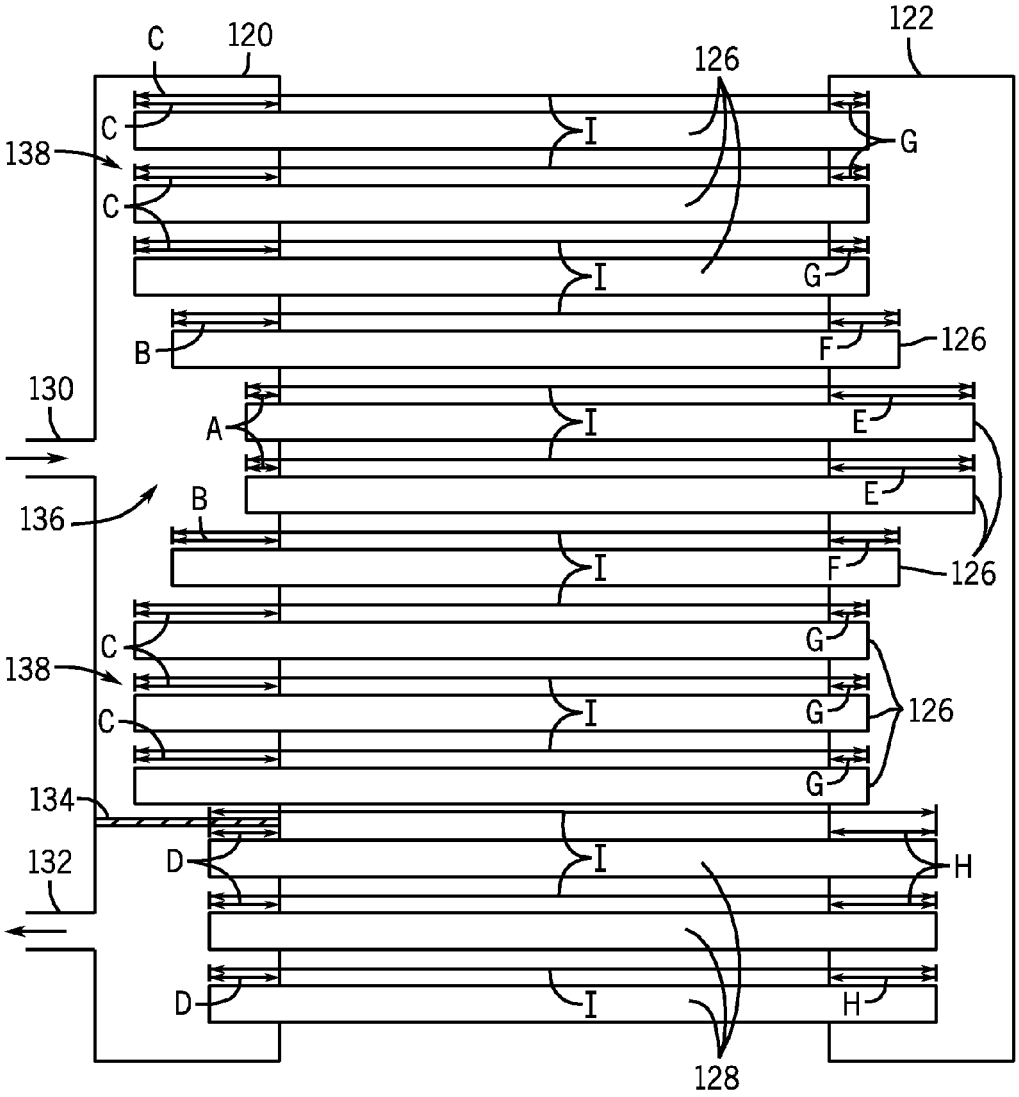
FIG. 17 is an elevation view of an exemplary two-pass heat exchanger with multichannel tubes inserted at different depths.

FIG. 17 shows an elevation view of a two-pass heat exchanger with varied tube insertion depths. Refrigerant enters the first manifold 120 through inlet 130 and flows through first tubes 126 to second manifold 122 where the refrigerant enters second tubes 128 to return to first manifold 120. The refrigerant then exits the heat exchanger through outlet 132 in first manifold 120. Baffle 134 divides first manifold 120 into an inlet chamber fluidly connected to first tubes 126 and an outlet chamber fluidly connected to second tubes 128.

The insertion depths of first tubes 126 generally increase within a region 136 adjacent to inlet 130 as distance from inlet 130 increases. Conversely, tube insertion depth remains substantially constant within regions 138 nonadjacent to inlet 130. Specifically, first tubes 126 positioned closest to inlet 130 have the smallest insertion depth A. The second tubes 126 have a larger insertion depth B, while the third tubes 126, located farthest from inlet 130, have the largest insertion depth C. As illustrated, each of the six tubes located farthest from inlet 130 have a substantially similar insertion depth C. As previously discussed, because a portion of the refrigerant flows through each successive tube 126 as the refrigerant flows through manifold 120, the quantity and/or volumetric flow rate of refrigerant may decrease as distance from inlet 130 increases. Therefore, positioning each tube 126 nonadjacent to inlet 130 at a substantially similar insertion depth C may not adversely affect the pressure drop because only a relatively small quantity of refrigerant is flowing through manifold 120 within the region nonadjacent to inlet 130.

In the present embodiment, the insertion depths of tubes 126 above inlet 130 are symmetrical with the insertion depths of tubes 126 below the inlet. However, other configurations may employ asymmetrical arrangements. As illustrated, each first tube 126 fluidly connects first and second manifolds 120 and 122 and is of generally the same length I. Therefore, as the insertion depth A, B and C increases within first manifold 120, a corresponding insertion depth E, F and G decreases. Specifically, the first tubes 126 positioned closest to inlet 130 have the smallest insertion depth A in the first manifold 120 and the largest insertion depth E in the second manifold 122. The second tubes 126 have an intermediate insertion depth B in the first manifold 120 and an intermediate insertion depth F in the second manifold 122. The third tubes 126 have the largest insertion depth C in the first manifold 120 and the smallest insertion depth G in the second manifold 122. The corresponding insertion depths E, F and G within second manifold 122 may enable each of first tubes 126 to have generally the same length I, which may facilitate reduced manufacturing costs.

After refrigerant flows through first tubes 126 to second manifold 122, the refrigerant enters second tubes 128. In the present embodiment, the second tubes 128 are substantially the same length I as the first tubes 126. As illustrated, the second tubes 128 are each inserted a depth D into first manifold 120 and a depth H into second manifold 122. As previously discussed, employing second tubes 128 having the same length I may reduce manufacturing costs.

Figure 18:
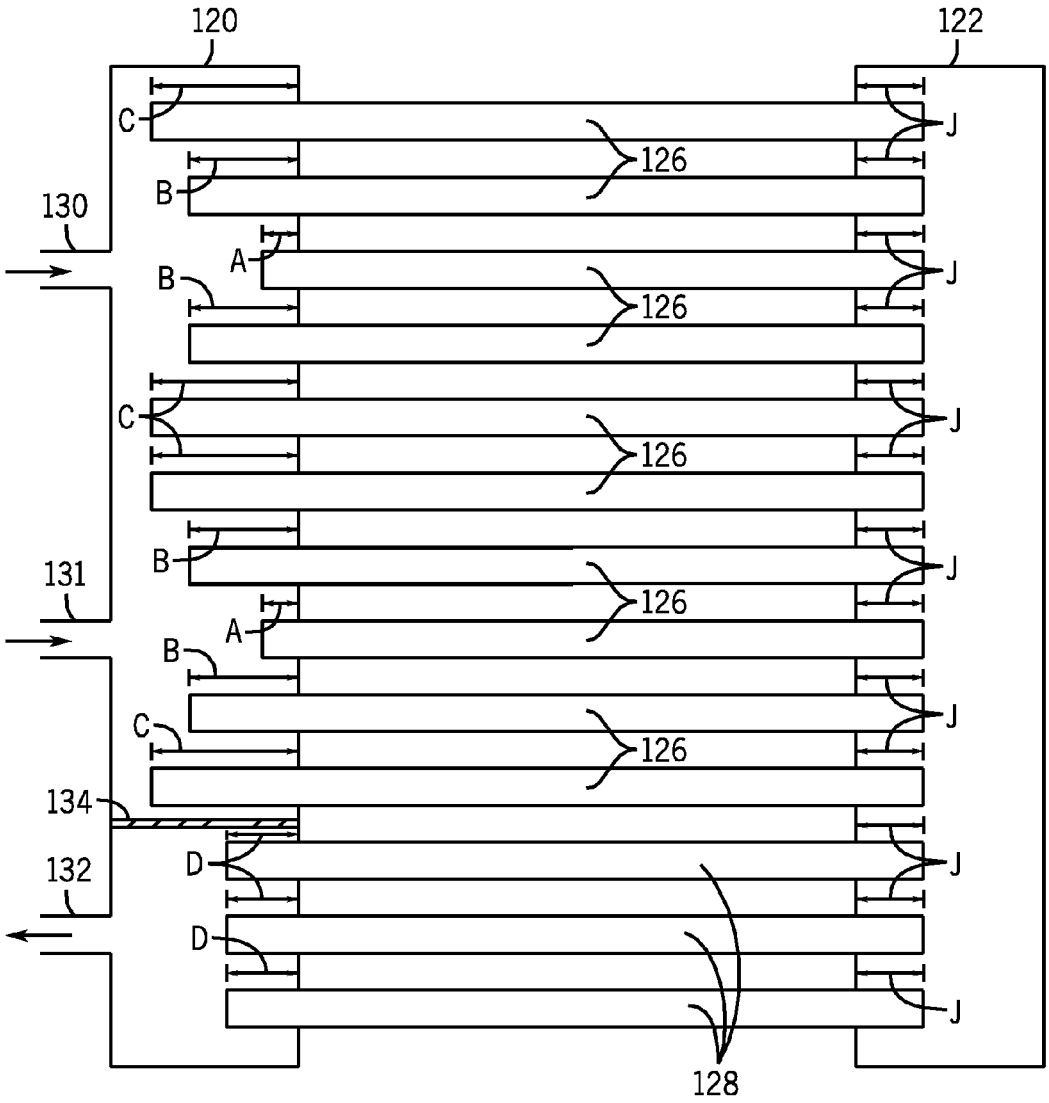
FIG. 18 is an elevation view of an exemplary two-pass heat exchanger with multichannel tubes inserted at different depths.

FIG. 18 is an alternative configuration of the heat exchanger shown in FIG. 17 employing two inlets 130 and 131. In the present embodiment, insertion depths of tubes 126 are selected to provide increased flow area near each inlet 130 and 131. Specifically, tube 126 positioned closest to inlet 130 has the smallest insertion depth A. Tubes 126 positioned farther from inlet 130 have an intermediate insertion depth B, while tubes 126 positioned yet farther from inlet 130 have the largest insertion depth C. Similarly, tube 126 positioned closest to inlet 131 has the smallest insertion depth A. Tubes 126 positioned farther from inlet 131 have an intermediate insertion depth B, while tubes 126 positioned yet farther from inlet 131 have the largest insertion depth C. Further embodiments may employ additional inlets, such as 3, 4, 5, 6, or more inlets. Tubes 126 of such embodiments may be generally arranged such that insertion depths are smallest near the inlets and progressive increase as distance from the inlets increase.

Furthermore, in the present embodiment, each tube 126 and 128 has a substantially constant insertion depth J into second manifold 122. Therefore, the length of each tube 126 and 128 varies based on distance from inlet 130 or 131. Maintaining a substantially constant insertion depth J into second manifold 122 may enhance flow through second manifold 122.

Of course, the tube configurations are provided by way of example, and are not intended to be limiting. For example, in other embodiments, the position of the inlet and outlet, the number of tubes, and the relative lengths of the insertion depths may vary. In certain embodiments, the insertion depths may vary only within the first or second manifold. Further, the insertion depths may vary only for the first or second tubes.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" and "microport." The term "microchannel" sometimes carries the connotation of tubes having fluid passages on the order of a micrometer and less. However, in the present context such terms are not intended to have any particular higher or lower dimensional threshold. Rather, the term "multichannel" used to describe and claim embodiments herein is intended to cover all such sizes. Other terms sometimes used in the art include "parallel flow" and "brazed aluminum." However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

While only certain features and embodiments of the invention have been illustrated and described, many modifications and changes may occur to those skilled in the art (e.g., variations in sizes, dimensions, structures, shapes and proportions of the various elements, mounting arrangements, use of materials, orientations, etc.) without materially departing from the novel teachings and advantages of the subject matter recited in the claims. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger comprising:

a first manifold with an inlet configured to receive a fluid;

a second manifold; and a plurality of multichannel tubes each having a first end extending within the first manifold and a second end extending within the second manifold, wherein each of the plurality of multichannel tubes is spaced along a length of the first manifold at a distance from the inlet;

wherein the first end of a first multichannel tube adjacent to the inlet includes a first profile, the first end of a second multichannel tube non-adjacent to the inlet includes a second profile, at least the first profile is non-rectangular, a first shape of the first profile is different than a second shape of the second profile, and the first profile is configured to provide a greater flow area through the first manifold than the second profile.

2. The heat exchanger of claim 1, wherein the first profile comprises a concave shape.

3. The heat exchanger of claim 1, wherein the first profile comprises at least one of a curved shape, a chevron shape, a half-hexagon shape, and a half-octagon shape.

4. The heat exchanger of claim 1, wherein the first profile comprises an apex at a lateral position corresponding to a lateral position of the inlet within the first manifold.

5. The heat exchanger of claim 1, wherein each of the plurality of multichannel tubes has a plurality of generally parallel flow paths configured to direct fluid between the first manifold and the second manifold.

6. The heat exchanger of claim 1, wherein each of the first ends includes a non-rectangular profile.

7. The heat exchanger of claim 1, wherein the first end of at least one multichannel tube nonadjacent to the inlet includes a substantially flat profile.

8. The heat exchanger of claim 1, wherein a length of each of the plurality of multichannel tubes is substantially the same.

9. The heat exchanger of claim 1, wherein the second end of the first multichannel tube includes a non-rectangular profile complementary to the first profile.

10. A heat exchanger comprising:

a first manifold with an inlet configured to receive a fluid;

a second manifold;

a first plurality of multichannel tubes having a plurality of generally parallel flow paths configured to direct the fluid between the first manifold and the second manifold, wherein at least one of the first plurality of multichannel tubes adjacent to the inlet includes a recessed end having a first shape and extending into the first manifold, and the recessed end of the at least one of the first plurality of multichannel tubes is configured to provide a greater flow area through the first manifold than an end of another one of the first plurality of multichannel tubes having a second shape and extending into the first manifold non-adjacent to the inlet, wherein the first shape is different than the second shape; and a second plurality of multichannel tubes configured to direct the fluid from the second manifold to the first manifold.

11. The heat exchanger of claim 10, wherein each of the first plurality of multichannel tubes has a recessed end extending into the first manifold, and each of the second plurality of multichannel tubes has a generally straight end extending into the first manifold.

12. The heat exchanger of claim 10, wherein the first plurality of multichannel tubes are spaced along a length of the first manifold, and wherein a curvature of the recessed end progressively increases along the length outwardly from the inlet.

13. The heat exchanger of claim 10, wherein the recessed end includes an apex proximate to a longitudinal axis extending generally parallel to the plurality of flow paths.

14. The heat exchanger of claim 13, wherein a length of the flow paths adjacent to the apex is less than a length of the flow paths nonadjacent to the apex.

15. The heat exchanger of claim 10, wherein the first plurality of multichannel tubes and the second plurality of multichannel tubes have generally flat cross sections.

16. A heat exchanger comprising:

a first manifold with an inlet configured to receive a fluid;

a second manifold;

a first plurality of multichannel tubes configured to direct the fluid from the first manifold to the second manifold and each extending within the first manifold at a first insertion depth, wherein the first insertion depth of a first multichannel tube of the first plurality of multichannel tubes adjacent to the inlet is less than the first insertion depth of a second multichannel tube of the first plurality of multichannel tubes non-adjacent to the inlet and longitudinally offset from the first multichannel tube in a first direction, and the first insertion depth of the first multichannel tube is less than the first insertion depth of a third multichannel tube of the first plurality of multichannel tubes non-adjacent to the inlet and longitudinally offset from the first multichannel tube in a second direction, opposite the first direction, to establish a greater flow area through the first manifold adjacent to the inlet; and a second plurality of multichannel tubes configured to direct the fluid from the second manifold to the first manifold.

17. The heat exchanger of claim 16, wherein the first insertion depth progressively increases along a length of the first manifold in the first direction and in the second direction.

18. The heat exchanger of claim 17, wherein the first insertion depth increases as the distance from the inlet increases.

19. The heat exchanger of claim 17, wherein each of the first plurality of multichannel tubes is substantially the same length.

20. The heat exchanger of claim 17, wherein each of the first plurality of multichannel tubes extends within the second manifold at a second insertion depth that progressively decreases along a length of the second manifold in the first direction.

21. The heat exchanger of claim 16, wherein each of the first plurality of multichannel tubes comprise a first end extending within the first manifold and a second end extending within the second manifold, the first end of at least one of the first plurality of multichannel tubes having a concave shape.

22. The heat exchanger of claim 21, wherein the second end of the at least one of the first plurality of multichannel tubes has a convex shape complementary to the concave shape.

* * * * *